US011768455B2

(12) United States Patent
Kikugawa et al.

(10) Patent No.: US 11,768,455 B2
(45) Date of Patent: Sep. 26, 2023

(54) FIXING DEVICE AND IMAGE FORMING APPARATUS

(71) Applicant: KYOCERA Document Solutions Inc., Osaka (JP)

(72) Inventors: Rina Kikugawa, Osaka (JP); Takashi Eiki, Osaka (JP); Akihiro Kondo, Osaka (JP); Ryohei Tokunaga, Osaka (JP); Yuta Kitabayashi, Osaka (JP); Hiroki Kawasaki, Osaka (JP); Shunsaku Fujii, Osaka (JP); Tei To, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/704,207

(22) Filed: Mar. 25, 2022

(65) Prior Publication Data

US 2022/0317605 A1 Oct. 6, 2022

(30) Foreign Application Priority Data

Mar. 30, 2021 (JP) ..... 2021-057163

(51) Int. Cl.
*G03G 15/20* (2006.01)
*H05B 3/00* (2006.01)

(52) U.S. Cl.
CPC ..... *G03G 15/2053* (2013.01); *H05B 3/0095* (2013.01)

(58) Field of Classification Search
CPC ..... G03G 15/2053; G03G 15/2042; G03G 2215/2035; G03G 15/2039
See application file for complete search history.

(56) References Cited

U.S. PATENT DOCUMENTS

| | | | | |
|---|---|---|---|---|
| 9,639,043 | B1 * | 5/2017 | Kimura | H05B 3/26 |
| 2017/0363995 | A1 * | 12/2017 | Takagi | G03G 15/2053 |
| 2019/0146388 | A1 * | 5/2019 | Kawasaki | H05B 3/26 399/331 |
| 2020/0026227 | A1 * | 1/2020 | Iwasaki | G03G 15/2042 |

FOREIGN PATENT DOCUMENTS

JP H09-292787 A 11/1997

* cited by examiner

*Primary Examiner* — Jessica L Eley
(74) *Attorney, Agent, or Firm* — Studebaker & Brackett PC

(57) ABSTRACT

A heater includes electrodes and heating element pieces. The electrodes energize the heating element pieces with electricity. The heating element pieces are connected to the electrodes and arranged through a gap portion in the heater in a main scanning direction. A ratio of a second surface area of the gap portion to a first surface area of the heating element pieces is 0<(second surface area of the gap portion)/(first surface area of the heating element pieces)≤0.5.

11 Claims, 11 Drawing Sheets

FIXING DEVICE AND IMAGE FORMING APPARATUS

INCORPORATION BY REFERENCE

The present application claims priority under 35 U.S.C. § 119 to Japanese Patent Application No. 2021-057163, filed on Mar. 30, 2021. The contents of this application are incorporated herein by reference in their entirety.

BACKGROUND

The present disclosure relates to a fixing device and an image forming apparatus.

A fixing device generally includes a fixing heater in which resistive heating elements are formed on the surface of a substrate.

SUMMARY

A fixing device according to an aspect of the present disclosure includes a heater which heats and fixes a toner image formed on a sheet. The heater includes a plurality of electrodes and a plurality of heating element pieces. The electrodes energize the heating element pieces with electricity. The heating element pieces are connected to the electrodes and arranged through a gap portion in the heater in a main scanning direction. A ratio of a second surface area of the gap portion to a first surface area of the heating element pieces is 0<(second surface area ($mm^2$) of the gap portion)/(first surface area ($mm^2$) of the heating element pieces)≤0.5.

DETAILED DESCRIPTION

Figure 1:
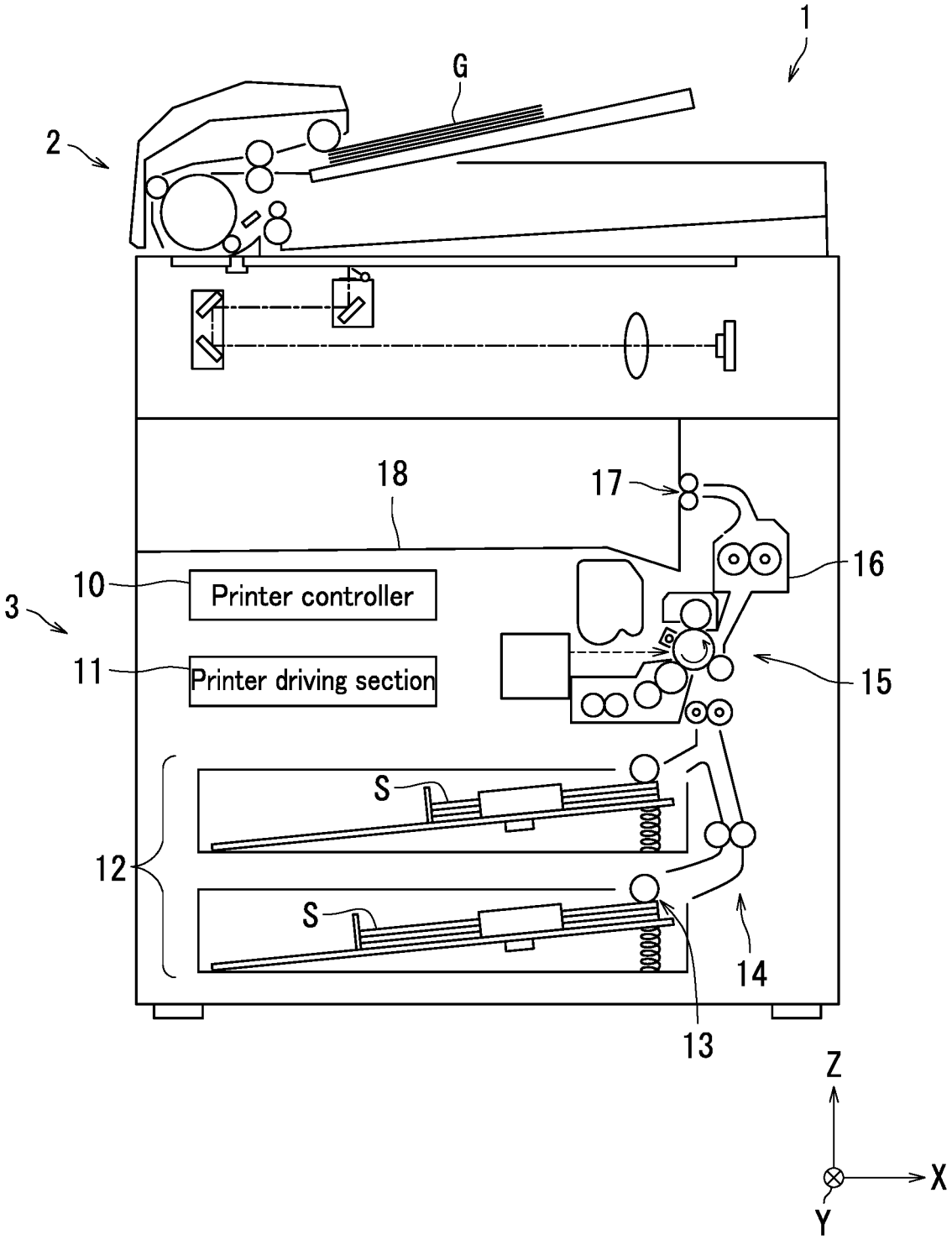
FIG. 1 is a diagram illustrating a multifunction peripheral including a fixing device and an image forming apparatus according to an embodiment of the present disclosure.

The following describes an embodiment of the present disclosure with reference to the accompanying drawings. Note that elements which are the same or equivalent are labeled with the same reference signs in the drawings and description thereof is not repeated. In the present embodiment, mutually orthogonal X, Y, and Z-axes are illustrated in the drawings. The Z-axis is parallel to a vertical plane, and the X and Y-axes are parallel to a horizontal plane.

In the present embodiment, a Y-axial direction may be described as a "main scanning direction". A Z-axial direction may also be described as a "sub-scanning direction". An X-axial direction may be described as a "direction orthogonal to the main scanning direction and the sub-scanning direction".

Figure 2:
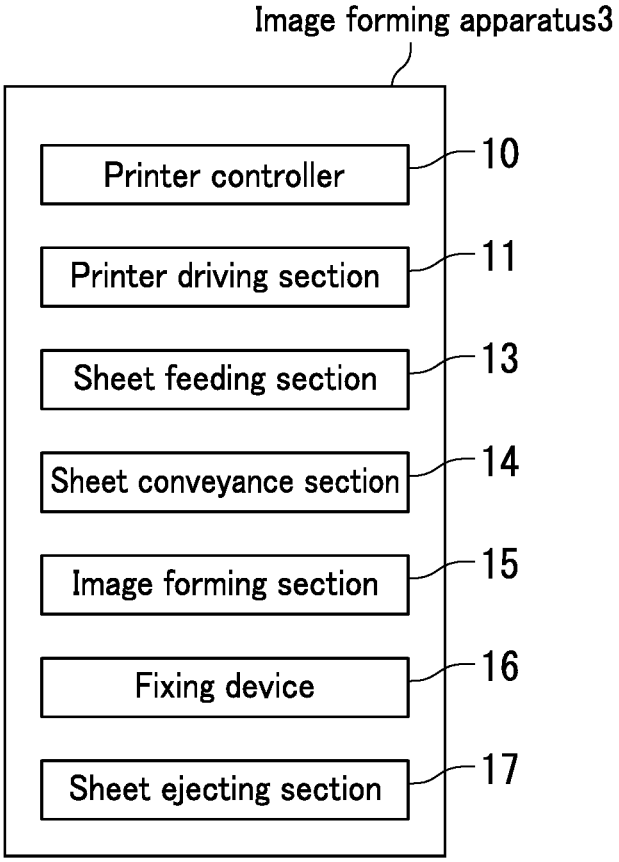
FIG. 2 is a block diagram illustrating a configuration of the image forming apparatus including the fixing device of the present embodiment.

A configuration of a multifunction peripheral 1 is described with reference to FIG. 1. FIG. 1 is a diagram illustrating the multifunction peripheral 1 including a fixing device 16 according to the present embodiment. A configuration of an image forming apparatus 3 including the fixing device 16 according to the present embodiment is described with reference to FIG. 2. FIG. 2 is a block diagram illustrating a configuration of the image forming apparatus 3 including the fixing device 16 of the present embodiment.

As illustrated in FIG. 1, the multifunction peripheral 1 includes a document reading device 2 and the image forming apparatus 3. The multifunction peripheral 1 is, for example, a multifunction printer (MFP) which combines the functions of two or more devices including a scanner, a copier, a printer, and a facsimile machine.

The document reading device 2 includes, for example, a document feed tray, a document feed section, a document conveyance section, a document reading section, an optical member, a document ejection section, and a document exit tray.

The image forming apparatus 3 includes a printer controller 10, a printer driving section 11, a sheet tray 12, a sheet feeding section 13, a sheet conveyance section 14, an image forming section 15, a fixing section 16 (fixing device 16), a sheet ejecting section 17, and a sheet exit tray 18.

The printer controller 10 controls the operation of each section of the image forming apparatus 3. The printer controller 10 may function as a controller which controls the operation of each section of the multifunction peripheral 1. Specific examples of the printer controller 10 include a central processing unit (CPU), a microprocessor unit (MPU), and an application-specific integrated circuit (ASIC).

The printer controller 10 can control the size of a sheet S to be fed to the fixing device 16. The printer controller 10 selects the size of the sheet S based on a job instruction and informs the size of the sheet S to the sheet feeding section 13.

The printer driving section 11 drives each section of the image forming apparatus 3. The printer driving section 11 may be a driving section which operates each section of the multifunction peripheral 1. Specific examples of the printer driving section 11 include an electric motor, an electromagnetic solenoid, a hydraulic cylinder, and a pneumatic cylinder.

The sheet S is loaded on the sheet tray 12. The sheet S is an example of a recording medium. The sheet tray 12 may include a tray and an ascending and descending member. The sheet feeding section 13 picks up and feeds the sheet S loaded on the sheet tray 12. A specific example of the sheet feeding section 13 is a pickup roller.

The sheet conveyance section 14 conveys the sheet S fed from the sheet tray 12. The sheet conveyance section 14 has a conveyance path. The conveyance path starts at the sheet tray 12 and extends through the image forming section 15 and the fixing section 16 to the sheet ejecting section 17. The sheet conveyance section 14 may include a conveyance roller and a registration roller in the conveyance path.

A plurality of conveyance rollers may be disposed in the conveyance path to convey the sheet S. The registration roller adjusts the timing at which the sheet S is conveyed to the image forming section 15. The sheet conveyance section 14 conveys the sheet S from the sheet tray 12 through the image forming section 15 and the fixing section 16 to the sheet ejecting section 17.

The image forming section 15 electrographically forms an unillustrated toner image on the sheet S based on document image data. The document image data indicates an image of a document G, for example.

The fixing section 16 applies heat and pressure to the toner image developed on the sheet S to fix the toner image to the sheet S. The fixing section 16 may be referred to as a "fixing device 16".

The sheet ejecting section 17 ejects the sheet S out of the casing of the multifunction peripheral 1 (image forming apparatus 3). A specific example of the sheet ejecting section 17 is an ejection roller.

The sheet S which has been ejected by the sheet ejecting section 17 is loaded on the sheet exit tray 18.

Figure 3:
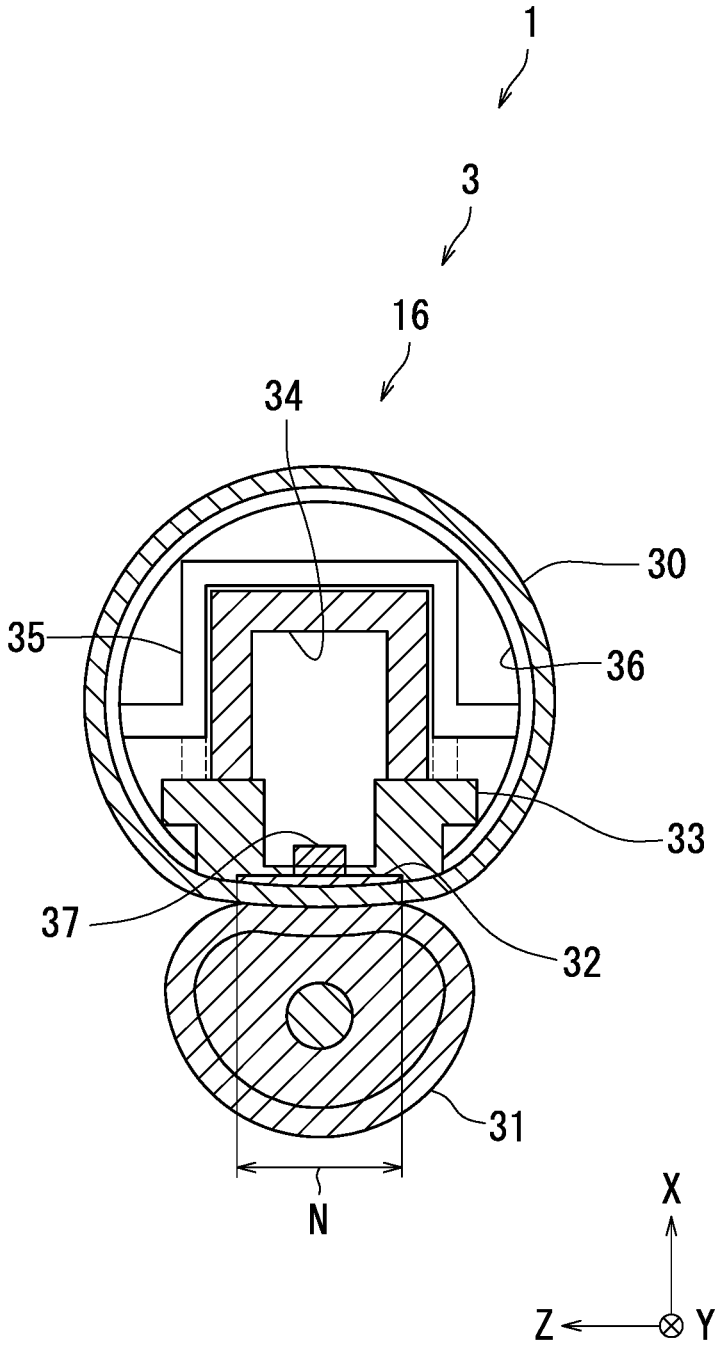
FIG. 3 is a cross-sectional view of a configuration of the fixing device of the present embodiment.

Next, a configuration of the fixing device 16 of the present embodiment is described in detail with reference to FIG. 3. FIG. 3 is a cross-sectional view of the configuration of the fixing device 16 of the present embodiment.

As illustrated in FIG. 3, the fixing device 16 includes a fixing belt 30, a pressure member 31, a heater 32, a heater holding member 33, stay sheet metal 34, a stay sheet metal holding section 35, a fixing belt holding section 36, and a temperature measuring section 37.

The fixing belt 30 heats and fixes the toner image formed on the sheet S. That is, the fixing belt 30 heats the sheet S (FIG. 1) on which the toner image is formed in the image forming section 15 illustrated in FIG. 1 and which is conveyed to the fixing device 16, thereby heating and fixing the toner image transferred to the sheet S.

The fixing belt 30 illustrated in FIG. 3 is an endless belt. The fixing belt 30 is substantially cylindrical. The fixing belt 30 is flexible.

The fixing belt 30 further has a plurality of layers. Examples of the layers of the fixing belt 30 include a polyimide layer containing polyimide, an elastic layer containing an elastic material such as silicone rubber, and a mold release layer. The mold release layer is formed on an outer circumferential surface of the polyimide layer. The mold release layer is a heat resistant fluororesin film, for example.

The pressure member 31 presses against (comes into contact with) the fixing belt 30 while being driven and rotated, thereby causing the fixing belt 30 to passively rotate. The pressure member 31 is substantially columnar, and is disposed opposite to the fixing belt 30. An example of the pressure member 31 is a pressure roller 31. In the following, the pressure member 31 may be referred to as a "pressure roller 31".

The pressure roller 31 has a columnar metal core, a cylindrical elastic layer, and a mold release layer. The elastic layer is formed on the metal core. The mold release layer is formed to cover the surface of the mold release layer.

The metal core is formed of stainless steel or aluminum, for example. The elastic layer is elastic and is formed of silicone rubber, for example. The mold release layer is formed of fluororesin, for example.

The heater 32 is connected to an unillustrated power supply and generates heat. The heater 32 heats the fixing belt 30. The heater 32 is positioned opposite to the inner peripheral surface of the fixing belt 30. The heater 32 may be pressed toward the inner peripheral surface of the fixing belt 30 by an unillustrated pressing member.

Examples of the heater 32 include a surface heater and an elongated thin plate heater. An example of the heater 32 is a ceramic heater. A ceramic heater has a ceramic substrate and a resistive heating element. The thickness of the heater 32 is 1 mm, for example. The heater 32 receives pressure from the pressure roller 31 through the fixing belt 30.

Through the pressure roller 31 pressing against the fixing belt 30, a nip part N is formed at the point of contact between the fixing belt 30 and the pressure roller 31. As the pressure roller 31 presses against the fixing belt 30, the heater 32 pressibly makes contact with the inner peripheral surface of the fixing belt 30. As such, the fixing belt 30 is heated by the heater 32 and the toner image formed on the sheet S (FIG. 1) passing through the nip part N is fixed to the sheet S.

A lubricating oil is applied to the inner peripheral surface of the fixing belt 30. The lubricating oil is interposed between the fixing belt 30 and the heater 32. The lubricating oil forms an oil film between the inner peripheral surface of the fixing belt 30 and the heater 32. The lubricating oil reduces friction between the fixing belt 30 and the heater 32.

A specific example of the lubricating oil is grease. Grease has a higher viscosity and lower fluidity than oil. As such, grease is partially solid or partially fluid at room temperature. An example of a grease is a partially solid or solid grease made by uniformly dispersing a thickening agent such as calcium, sodium, lithium or aluminum soap (fatty acid salt) in a liquid lubricant.

The heater holding member 33 guides the fixing belt 30 such that the fixing belt 30 can circumferentially rotate, and holds the heater 32 which heats the fixing belt 30.

The stay sheet metal 34 reinforces the heater holding member 33. The stay sheet metal 34 is an elongated metal stay member, for example. The stay sheet metal 34 may be formed in a sideways U-shape, a U-shape, or a V-shape.

The stay sheet metal holding section 35 holds the stay sheet metal 34 such that the stay sheet metal 34 is fixed to the heater holding member 33.

The fixing belt holding section 36 guides the fixing belt 30 such that the fixing belt 30 can circumferentially rotate.

Figure 4:
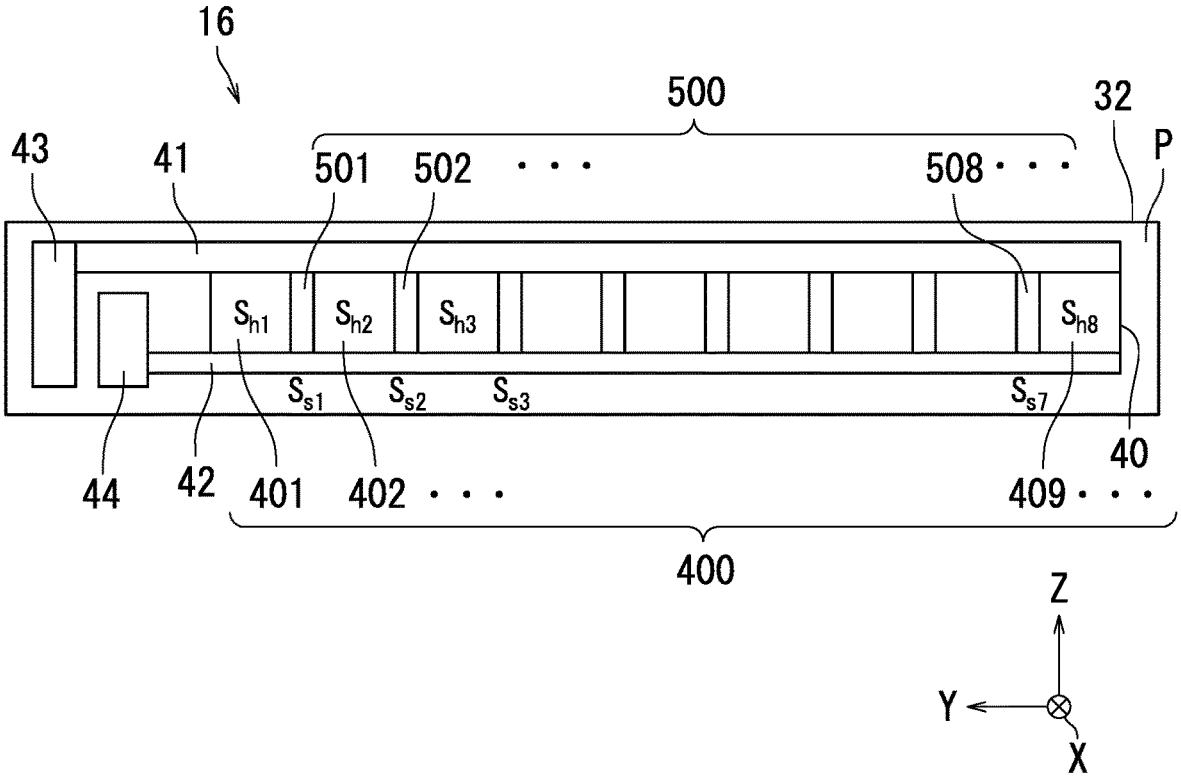
FIG. 4 is a plan view of a heater in the fixing device of the present embodiment.
Figure 5:
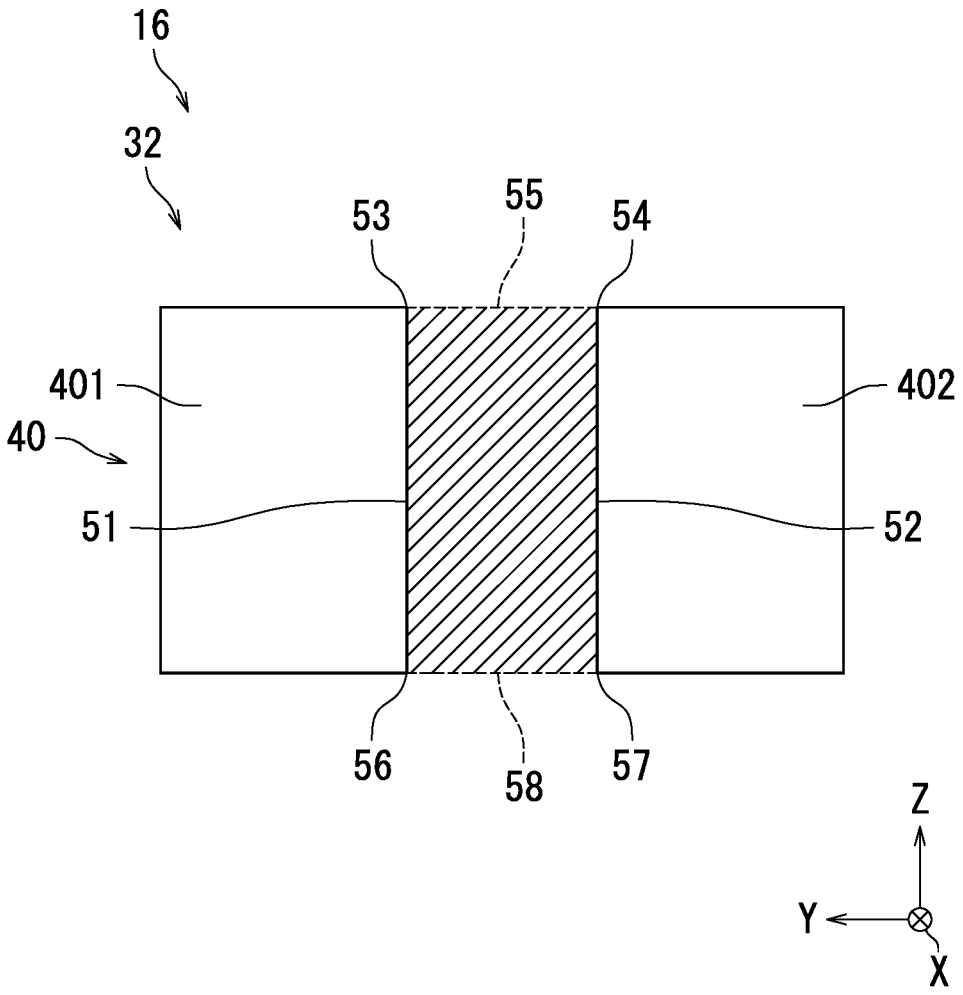
FIG. 5 is an enlarged view of heating element pieces and a gap portion.
Figure 6:
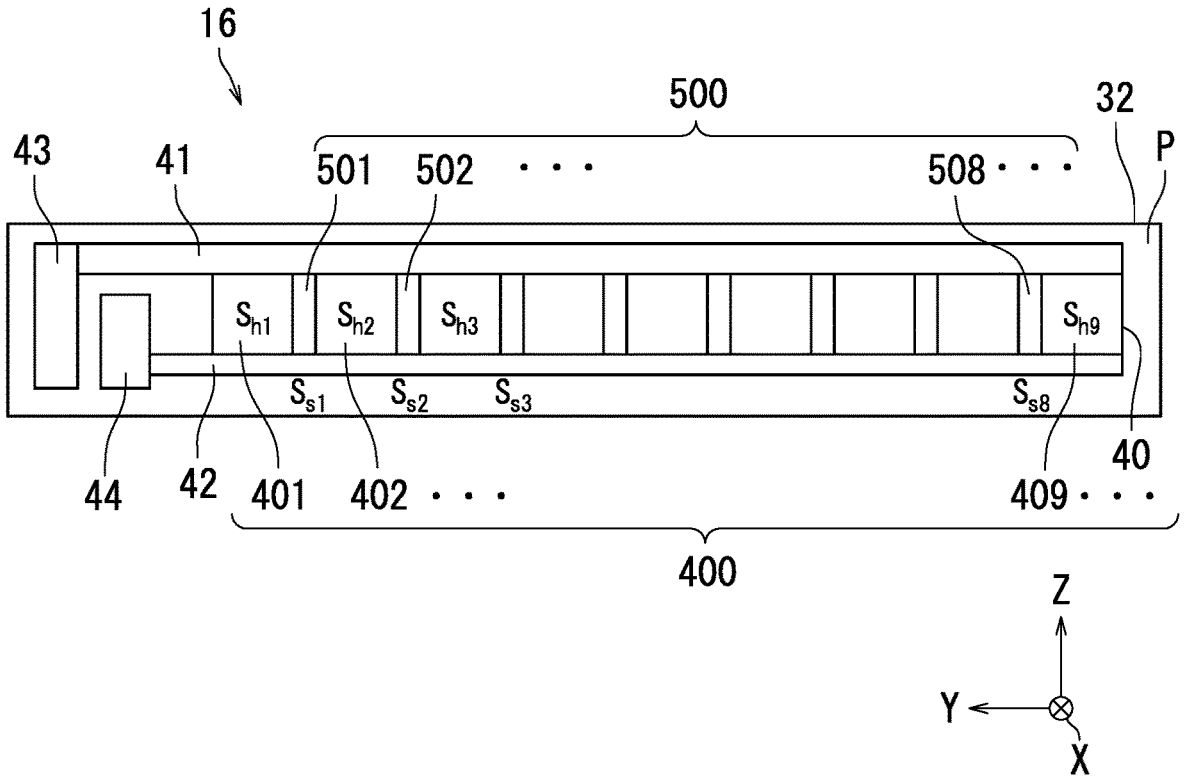
FIG. 6 is a diagram illustrating another example of the heater.
Figure 7A:
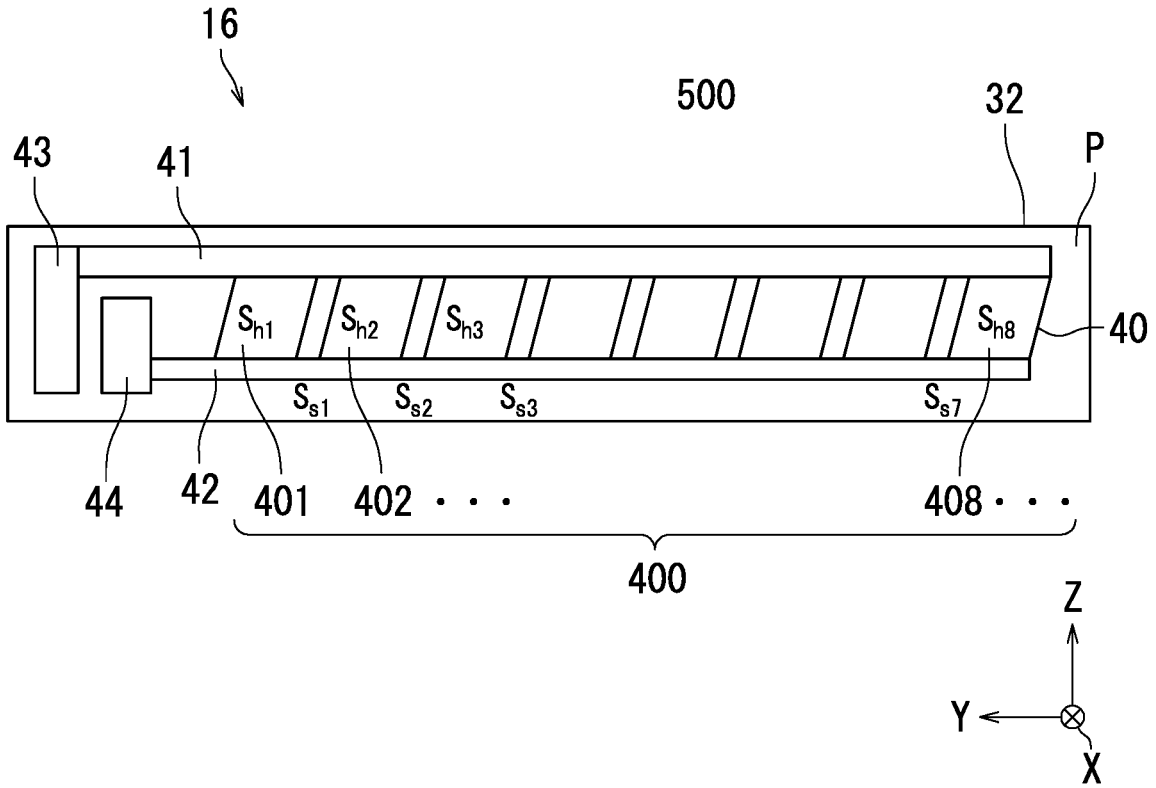
FIGS. 7A and 7B are diagrams illustrating examples in which the heating element pieces are parallelograms or trapezoids.
Figure 7B:
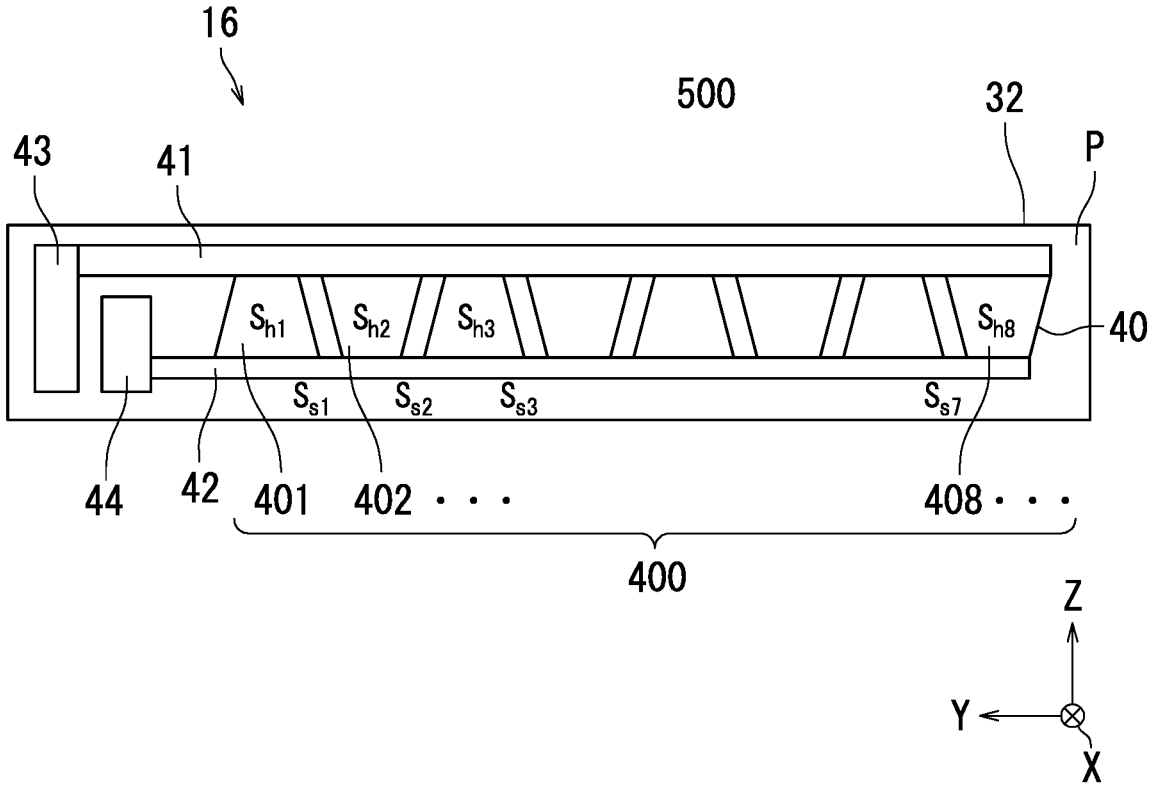
Figure 8:
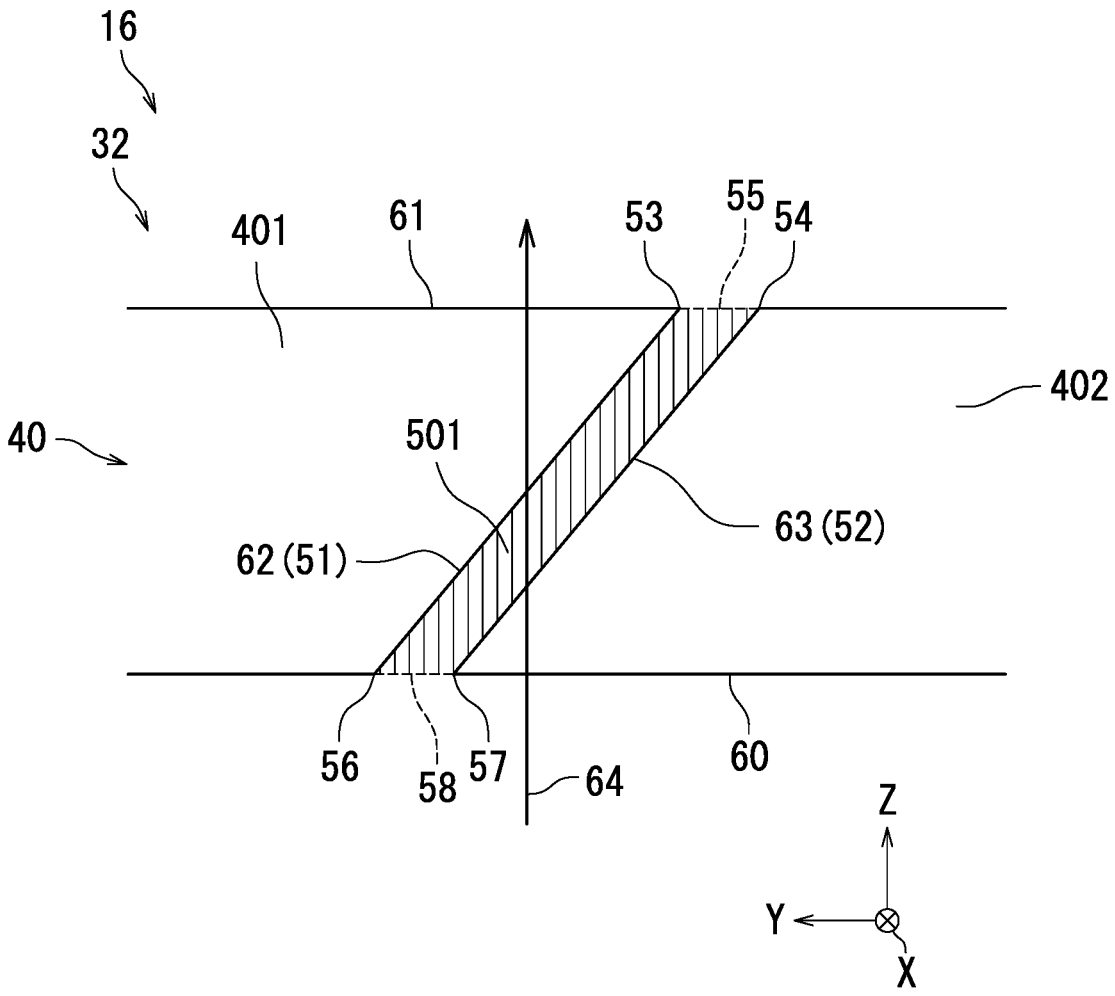
FIG. 8 is a detailed diagram illustrating an example in which the heating element pieces are parallelograms or trapezoids.
Figure 9:
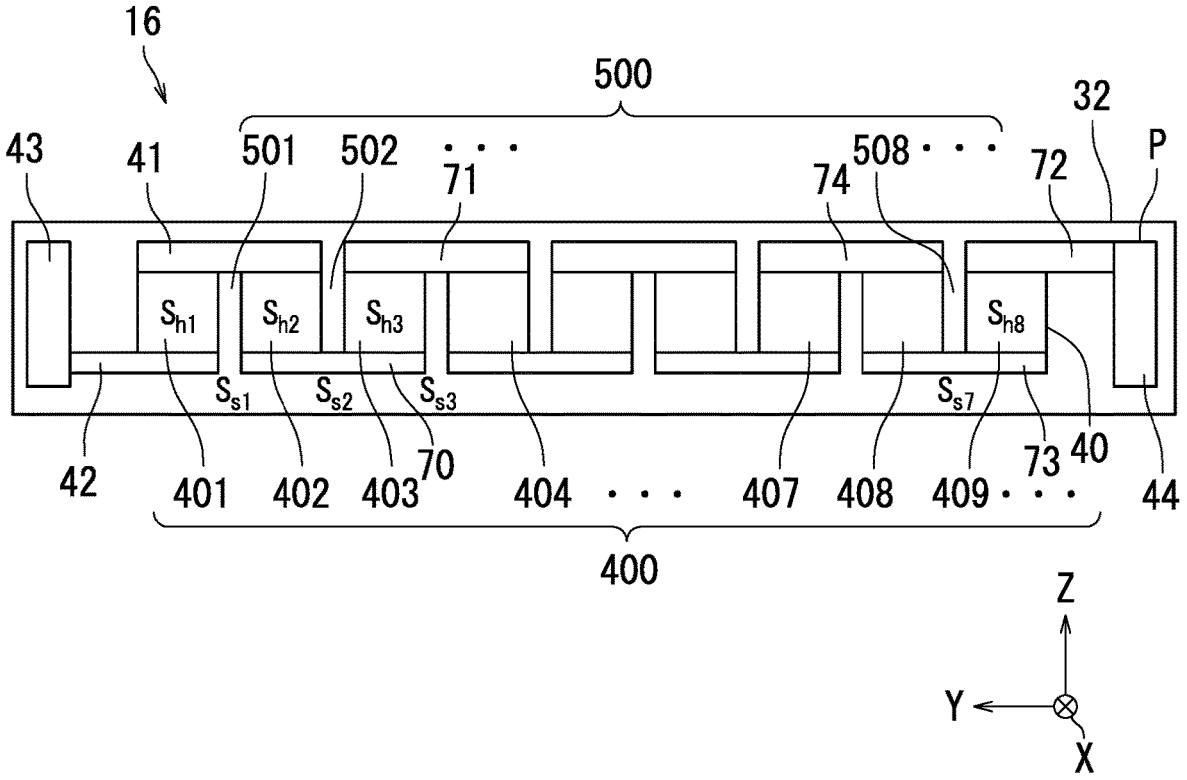
FIG. 9 is a diagram illustrating yet another example of the heater.
Figure 10:
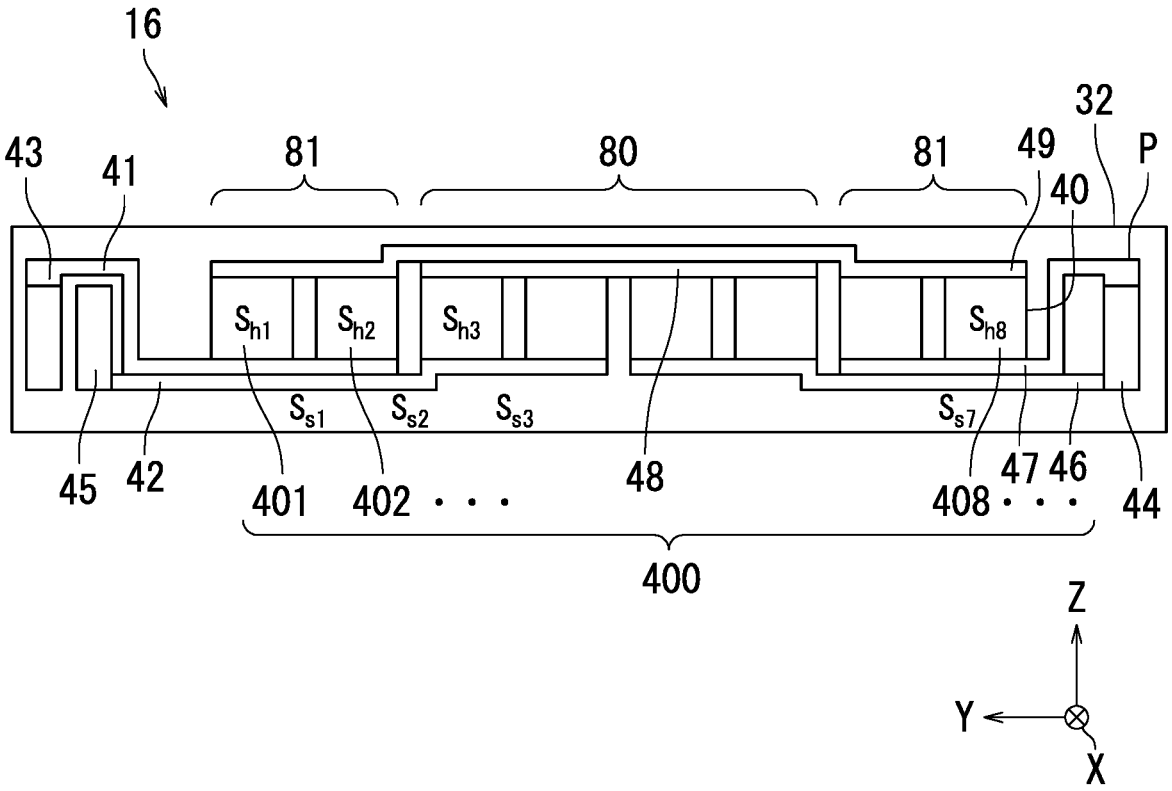
FIG. 10 is a diagram illustrating still another example of the heater.
Figure 11:
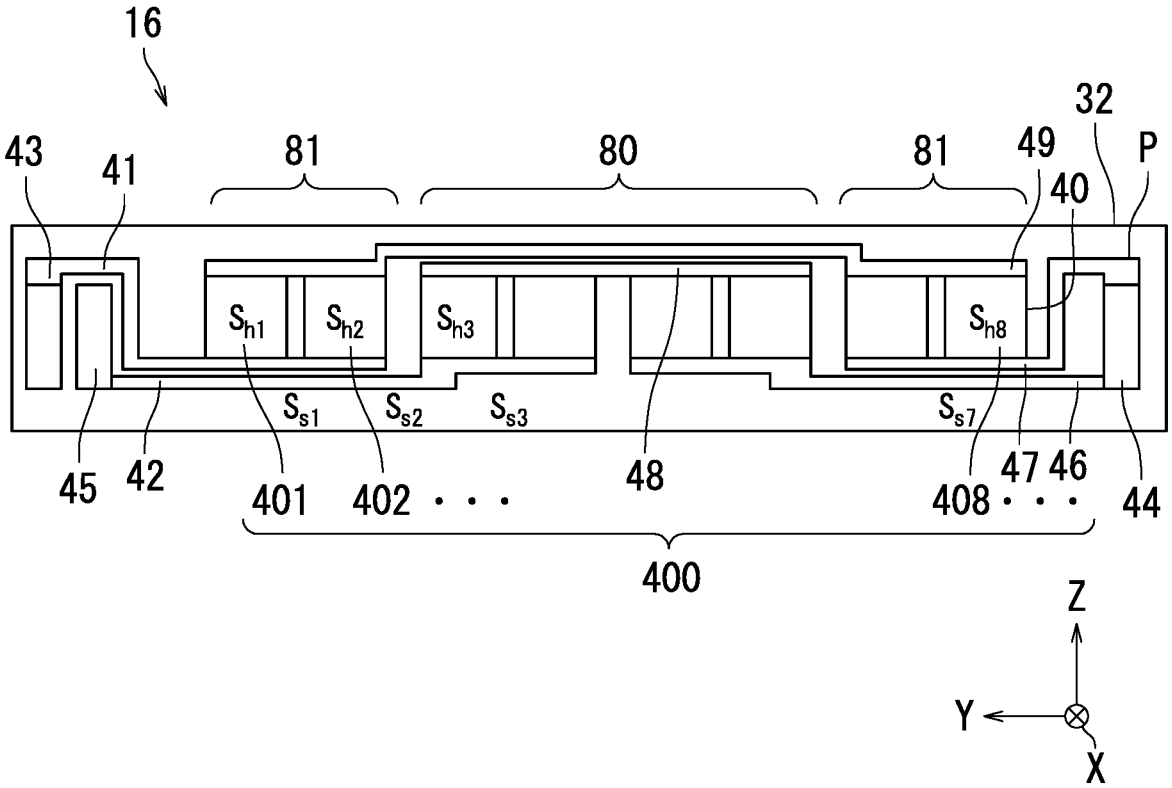
FIG. 11 is a diagram illustrating yet one more example of the heater.

Next, the structure of the heater 32 is described in detail with further reference to FIGS. 4 to 11 in addition to FIGS. 1 to 3. FIG. 4 is a plan view of the heater 32 in the fixing device 16 of the present embodiment. FIG. 5 is an enlarged view of heating element pieces 400 and a gap portion 500. FIG. 6 is a diagram illustrating another example of the heater 32. FIGS. 7A and 7B are diagrams illustrating examples in which the heating element pieces 400 are parallelograms or trapezoids. FIG. 8 is a detailed diagram illustrating an example in which the heating element pieces 400 are parallelograms or trapezoids. FIG. 9 is a diagram illustrating yet another example of the heater 32. FIGS. 10 and 11 are diagrams illustrating still other examples of the heater 32.

The fixing device 16 of the present embodiment includes the heater 32 which heats and fixes the toner image formed on the sheet S. The heater 32 includes electrodes (41, 42) and a plurality of heating element pieces 400. The electrodes (41, 42) energize the heating element pieces 400 with electricity. The heating element pieces 400 are connected to the electrodes (41, 42) and are arranged through gap portions 500 in the heater 32 in the main scanning direction. The ratio of a second surface area Ss ($mm^2$) of the gap portions 500 to a first surface area Sh ($mm^2$) of the heating element pieces 400 is (0<(second surface area Ss ($mm^2$) of the gap portions 500)/(first surface area Sh ($mm^2$) of the heating element pieces 400)≤0.5).

As specifically shown in FIG. 4, the heater 32 includes a heating element 40, an electrode 41, an electrode 42, a terminal 43, and a terminal 44.

The heating element 40 includes a plurality of heating element pieces 400. The heating element pieces 400 include a heating element piece 401, a heating element piece 402, . . . , a heating element piece 409, and so on.

The electrodes 41 and 42 are connected to an unillustrated power supply and energize the heating element pieces 400 with electricity. The heating element pieces 400 are connected to the electrodes 41 and 42 and are arranged through the gap portions 500 in the heater 32 in the main scanning direction.

The heating element pieces 400 generate Joule heat due to the unillustrated power supply supplying electricity through the electrodes 41 and 42, thereby heating the fixing belt 30.

The heating element pieces 400 are arranged in the main scanning direction on an opposing surface P of the heater 32 opposite to the sheet S. A heating element piece 400 is a resistive heating element with a higher resistivity than the materials which make up the electrodes 41 and 42, and examples thereof include Ag/Pd (silver palladium), $RuO_2$ (ruthenium oxide), and $Ta_2N$ (tantalum nitride).

The heating element piece 400 is formed, for example, by printing a thick film of ruthenium oxide paste or the like and then baking it. Note that the heating element piece 400 may be formed using thin film formation technology such as sputtering.

The electrode 41 is connected to a downstream side of the heating element piece 400 in the sub-scanning direction and extends parallel to the heating element 40. The electrode 42 is connected to an upstream side of the heating element piece 400 in the sub-scanning direction and extends parallel to the heating element 40.

The electrodes 41 and 42 are made from, for example, resinate Au with additive elements such as rhodium, vanadium, bismuth, and silicon. The electrodes 41 and 42 may be formed by printing a thick film of resinate Au paste and then baking it. The electrodes 41 and 42 may be formed using thin film formation technology such as sputtering. The electrodes 41 and 42 may be configured by stacking a plurality of Au layers.

As later described with reference to FIGS. 10 and 11, an electrode 46, an electrode 47, and an electrode 48 may also have the same configuration.

The terminal 43 is connected to the electrode 41. The terminal 43 is connected to an unillustrated metal wire and energizes the electrode 41 with electricity supplied from the unillustrated power supply. The terminal 43 is connectable and disconnectable with the unillustrated metal wire.

The surface area of the heating element piece 401 is referred to as a surface area Sh1 ($mm^2$). The surface area of the heating element piece 402 is referred to as a surface area Sh2 ($mm^2$). In the same manner, the surface area of a heating element piece (400+n) is referred to as a surface area Shn ($mm^2$). n is a natural number.

The first surface area Sh ($mm^2$) of the heating element 40 (heating element pieces 400) is (first surface area Sh ($mm^2$) =surface area Sh1 ($mm^2$)+surface area Sh2 ($mm^2$)+ . . . surface area Shn ($mm^2$).

The gap portions 500 are interposed between mutually adjacent heating element pieces 400. The gap portions 500 electrically insulate the heating element pieces 400.

A gap portion 501 is interposed between the heating element piece 401 and the heating element piece 402. A gap portion 502 is interposed between the heating element piece 402 and the heating element piece 403. In the same manner as follows, a gap portion (500+k) is interposed between the heating element piece (400+n) and a heating element piece (400+(n+1)). k is a natural number.

The second surface area Ss ($mm^2$) of the gap portions 500 is (second surface area Ss ($mm^2$)=surface area Ss1 ($mm^2$)+ surface area Ss2 ($mm^2$)+ . . . +surface area Ssk ($mm^2$).

The ratio of the second surface area Ss ($mm^2$) of the gap portions 500 to the first surface area Sh ($mm^2$) of the heating element pieces 400 may be (0<(second surface area Ss ($mm^2$) of the gap portions 500)/(first surface area Sh ($mm^2$) of the heating element pieces 400)≤0.5).

According to the present embodiment, when the heating element 40 is formed by a plurality of heating element pieces 400, the amount of expensive material used can be reduced by appropriately disposing the heating element pieces 400.

Next, FIG. 5 is a diagram which describes in detail a gap portion 500 interposed between mutually adjacent heating element pieces 400.

As illustrated in FIG. 5, a gap portion 500 (gap portion 501) may be a region surrounded by opposite edges 51 and 52 of mutually adjacent heating element pieces 400 (heating element pieces 401 and 402), an imaginary edge 55 which connects vertices 53 and 54 of the opposite edges 51 and 52 on a downstream side in the sub-scanning direction, and an imaginary edge 58 which connects vertices 56 and 57 of the opposite edges 51 and 52 on an upstream side in the sub-scanning direction.

The surface area Ss ($mm^2$) of a gap portion 500 between heating element pieces 400 at an end of the heater 32 in the main scanning direction may be larger than the surface area Ss ($mm^2$) of a gap portion 500 at the center in the main scanning direction.

Specifically, surface area Ss1 ($mm^2$)>surface area Ss2 ($mm^2$)>surface area Ss3 ($mm^2$)> . . . may be used in FIG. 6. Furthermore, surface area Ss (k+2) ($mm^2$)>surface area Ss (k+1) ($mm^2$)>surface area Ssk ($mm^2$) may be used.

In FIG. 6, the surface area Ss of any gap portion 500 between heating element pieces 400 at an end of the heater 32 in the main scanning direction may be larger than the surface area Ss of any gap portion 500 at the center in the main scanning direction.

That is, for example, when sheets S of different sizes such as a B5-sized sheet S and an A4-sized sheet S undergo fixing processing, the heating element pieces 400 at the center of the heater 32 in the main scanning direction are used more frequently than the heating element pieces 400 at the ends of the heater 32 in the main scanning direction. As such, the heating element pieces 400 at the center of the heater 32 in the main scanning direction are more likely to lose heat to a sheet S than the heating element pieces 400 at the ends of the heater 32 in the main scanning direction. Accordingly, deterioration in image quality due to fixing failure is more likely to occur at the center of the heater 32 in the main scanning direction.

According to the present embodiment, deterioration in image quality due to fixing failure can be inhibited by appropriately setting the disposition gaps between the heating element pieces 400.

Next, a number of embodiments of the heating element pieces 400 are described with continued reference to FIGS. 4 to 8.

As illustrated in FIG. 4, the heating element pieces 400 may be arranged at an equal interval in the main scanning direction.

As illustrated in FIG. 7, shapes of the heating element pieces 400 may include squares, rectangles, parallelograms, and trapezoids.

FIGS. 4 and 6 are embodiments in which the shapes of the heating element pieces 400 are squares or rectangles.

FIG. 7A is an embodiment in which the shapes of the heating element pieces 400 are parallelograms.

FIG. 7B is an embodiment in which the shapes of the heating element pieces 400 are trapezoids.

FIGS. 7A and 7B show that the shapes of the heating element pieces 400 may be any one or a combination of squares, rectangles, parallelograms, and trapezoids. For example, the shapes of the heating element pieces 400 may be a combination of squares and rectangles. For another example, the shapes of the heating element pieces 400 may be a combination of parallelograms and trapezoids.

When the shape of a heating element piece 400 is a parallelogram or a trapezoid, an imaginary sub-scanning directional axis 64 of the sheet S may pass through one or more of the heating element pieces 400.

As illustrated in FIG. 8, focus is put on the mutually adjacent heating element pieces 401 and 402 among the heating element pieces 400.

When the sheet S on which the toner image is formed is conveyed from an upstream side of the heater 32 in the sub-scanning direction to a downstream side in the sub-scanning direction, the sub-scanning directional axis 64 is imagined where the sheet S passes the heater 32.

The sub-scanning directional axis 64 may only pass the heating element piece 401. The sub-scanning directional axis 64 may pass both a downstream edge 61 of the heating element piece 401 and an upstream edge 60 of the heating element piece 402. The sub-scanning directional axis 64 may only pass the heating element piece 402. That is, the sub-scanning directional axis 64 need only pass at least a portion of a heating element piece 400.

In order for the sub-scanning directional axis 64 to pass at least a portion of a heating element piece 400, any one of the following conditions must be met.

As illustrated in FIG. 8, in order for the sub-scanning directional axis 64 to pass a hypotenuse 62 of the heating element piece 401, the vertex 53 of the heating element piece 401 must be disposed on a side opposite to the vertex 56 of the heating element piece 401 with respect to the sub-scanning directional axis 64. In order for the sub-scanning directional axis 64 to pass a hypotenuse 63 of the heating element piece 402, the vertex 54 of the heating element piece 402 must be disposed on a side opposite to the vertex 57 of the heating element piece 402 with respect to the sub-scanning directional axis 64.

In order for the sub-scanning directional axis 64 to pass both the heating element pieces 401 and 402, the vertex 53 of the heating element piece 401 must be disposed on an opposite side to the vertex 57 of the heating element piece 402 with respect to the sub-scanning directional axis 64.

In order for the sub-scanning directional axis 64 to pass the hypotenuse 63 of the heating element piece 402, the vertex 54 of the heating element piece 402 must be disposed on a side opposite to the vertex 57 of the heating element piece 402 with respect to the sub-scanning directional axis 64.

The above conditions can be applied to the other heating element pieces 400 illustrated in FIGS. 7A and 7B.

According to the present embodiment, the toner image formed on the sheet S is suitably fixed by passing any of the heating element pieces 400 of the heating element 40, and image deterioration due to fixing failure can be inhibited.

The surface area Sh ($mm^2$) of a heating element piece 400 at an end of the heater 32 in the main scanning direction may be smaller than the surface area Sh ($mm^2$) of a heating element piece 400 at the center in the main scanning direction.

Specifically, surface area Sh1 ($mm^2$)<surface area Sh2 ($mm^2$)<surface area Sh3 ($mm^2$)< . . . may be used in FIG. 4. Furthermore, surface area Sh (n+2) ($mm^2$)<surface area Sh (n+1) ($mm^2$)<surface area Shn ($mm^2$) may be used.

In FIG. 4, the surface area Sh ($mm^2$) of any of the heating element pieces 400 at the ends of the heater 32 in the main scanning direction may be larger than the surface area Sh ($mm^2$) of any of the heating element pieces 400 at the center in the main scanning direction.

According to the present embodiment, deterioration in image quality due to fixing failure can be inhibited by appropriately setting the disposition gaps between the heating element pieces 400.

Next, another embodiment of the heater 32 of the fixing device 16 is described with reference to FIG. 9. FIG. 9 is a diagram illustrating yet another example of the heater 32.

The electrodes (41, 42) are arranged on an upstream side and a downstream side of the heating element pieces 400 in the sub-scanning direction, and may energize the heating element pieces 400 from the upstream side to the downstream side in the sub-scanning direction or from the downstream side to the upstream side in the sub-scanning direction.

As illustrated in FIG. 9, the terminal 43 is disposed at one end of the heater 32 in the main scanning direction. The terminal 44 is disposed at the other end of the heater 32 in the main scanning direction.

The electrode 42 connected to the terminal 43 is connected to the upstream side of the heating element piece 401 in the sub-scanning direction. The electrode 41 is connected to the downstream side of the heating element pieces 402 and 403 in the sub-scanning direction. An electrode 70 is connected to the upstream side of the heating element pieces 402 and 403 in the sub-scanning direction. An electrode 71 is connected to the downstream side of the heating element pieces 403 and 404 in the sub-scanning direction.

An electrode 72 connected to the terminal 44 is connected to the downstream side of the heating element piece 409 in the sub-scanning direction. An electrode 73 is connected to the upstream side of a heating element piece 408 and the heating element piece 409 in the sub-scanning direction. An electrode 74 is connected to the downstream side of the heating element pieces 407 and 408 in the sub-scanning direction.

When the terminal 43 is positive (+) and the terminal 44 is negative (−), the electricity supplied from the unillustrated power supply is supplied to the electrode 42 from the terminal 43 and the electric current flows from the upstream side to the downstream side in the sub-scanning direction in the heating element piece 401 connected to the electrodes 41 and 42. The electric current flows from the upstream side to the downstream side in the sub-scanning direction in the heating element piece 403 connected to the electrodes 70 and 71.

The electric current flows from the downstream side to the upstream side in the sub-scanning direction in the heating element piece 402 connected to the electrodes 41 and 70.

Through the above configuration in the present embodiment, the number of electrodes can be reduced compared to the electrodes 41 and 42 as illustrated in FIG. 4.

Next, yet another embodiment of the heater 32 of the fixing device 16 is described with reference to FIGS. 10 and 11. FIGS. 10 and 11 are diagrams illustrating still other examples of the heater 32.

As illustrated in FIG. 10, the heating element pieces 400 are divided into at least three heating element groups (first heating element group 80, second heating element groups 81) in the main scanning direction, and the electrodes are divided into first electrodes (electrodes 42, 46, and 48) that energize the heating element group (first heating element group 80) at the center in the main scanning direction and second electrodes (electrodes 41, 47, and 49) that energize the heating element groups (second heating element groups 81) at the ends in the main scanning direction.

For a specific example, the fixing device 16 can perform fixing processing on a small (B5-sized) sheet S and a medium-to-large (A4-sized) sheet S. When the fixing device 16 performs fixing processing on a B5-sized sheet S, the unillustrated power supply energizes the first electrodes (electrodes 42, 46, and 48) through the terminal 45.

The electric current flows through the first heating element group 80 connected to the first electrodes (electrodes 42, 46, and 48) causing the first heating element group 80 to generate heat. As such, the toner image is heated and fixed to the B5-sized sheet S which passes the first heating element group 80.

When the fixing device 16 performs fixing processing on an A4-sized sheet S, the unillustrated power supply energizes the first electrodes (electrodes 42, 46, and 48) and the second electrodes (electrodes 41, 47, and 49) through the terminals 43, 44, and 45.

The electric current flows through the first heating element group 80 connected to the first electrodes (electrodes 42, 46, and 48) causing the first heating element group 80 to generate heat. The electric current flows through the second heating element groups 81 connected to the second electrodes (electrodes 41, 47, and 49) causing the second heating element groups 81 to generate heat. As such, the toner image is heated and fixed to the A4-sized sheet S which passes the first heating element group 80 and the second heating element groups 81.

In the present embodiment, the heating element pieces 400 include three mutually adjacent heating element pieces 400 (heating element piece (401+(n−1)), heating element piece (401+n), and heating element piece (401+(n+1)) aligned at an unequal interval in the main scanning direction.

According to the present embodiment, the heating element pieces 400 can be efficiently selected to generate heat according to the size of the sheet S, the lifespan of the heating element 40 can be extended, and the electricity can be reduced.

An embodiment of the present disclosure has been described above with reference to the accompanying drawings. However, the present disclosure is not limited to the above embodiment and can be implemented in various manners within a scope not departing from the gist thereof. The drawings mainly illustrate various constituent elements schematically for ease of understanding. Aspects such as thickness, length, and number of the constituent elements illustrated in the drawings may differ in practice for convenience of drawing preparation. Furthermore, aspects such as material, shape, and dimension of the constituent elements illustrated in the above embodiment are one example and not particular limitations. Various alterations can be made within a scope not substantially deviating from the effects of the present disclosure.

What is claimed is:

1. A fixing device comprising:

a fixing belt configured to heat and fix a toner image formed on a sheet conveyed in a sub-scanning direction; and a surface heater configured to heat an inner peripheral surface of the fixing belt by pressibly making contact with the inner peripheral surface of the fixing belt, wherein the surface heater includes, on a surface thereof that comes in contact with the inner peripheral surface of the fixing belt:

a plurality of heating element pieces arranged in a main scanning direction perpendicular to the sub-scanning direction; and a plurality of electrodes which energize the heating element pieces with electricity, the heating element pieces each have paired sides extending in parallel to each other in the main scanning direction on an upstream side thereof in the sub-scanning direction and a downstream side thereof in the sub-scanning direction to shape into a parallelogram or a trapezoid with oblique lines inclined with respect to the main scanning line, the heating element pieces are connected to the electrodes and arranged through a gap portion in the surface heater in the main scanning direction, an imaginary sub-scanning directional axis of the sheet passes an oblique line of any of mutually adjacent heating element pieces of the heating element pieces, and a ratio of a second surface area ($mm^2$) of the gap portion to a first surface area ($mm^2$) of the heating element pieces is 0<(second surface area ($mm^2$) of the gap portion)/(first surface area ($mm^2$) of the heating element pieces)≤0.5.

2. The fixing device according to claim 1, wherein the gap portion is a region surrounded by opposite edges of mutually adjacent heating element pieces of the heating element pieces, an imaginary edge connecting vertices of an opposite edge on a downstream side in a sub-scanning direction, and an imaginary edge connecting vertices of an opposite edge on an upstream side in the sub-scanning direction.

3. The fixing device according to claim 1, wherein a surface area ($mm^2$) of the gap portion between the heating element pieces at an end of the surface heater in the main scanning direction is larger than a surface area ($mm^2$) of the gap portion at a center in the main scanning direction.

4. The fixing device according to claim 1, wherein the heating element pieces are arranged at an equal interval in the main scanning direction.

5. The fixing device according to claim 1, wherein a surface area ($mm^2$) of a heating element piece of the heating element pieces located at an end of the surface heater in the main scanning direction is smaller than a surface area ($mm^2$) of a heating element piece of the heating element pieces located at a center in the main scanning direction.

6. The fixing device according to claim 1, wherein the electrodes are arranged on an upstream side and a downstream side of the heating element pieces in a sub-scanning direction, and energizes the heating element pieces from the upstream side to the downstream side in the sub-scanning direction or from the downstream side to the upstream side in the sub-scanning direction.

7. The fixing device according to claim 1, wherein the heating element pieces are divided into at least three heating element groups in the main scanning direction, and the electrodes are divided into:

a first electrode which energizes a heating element group at a center in the main scanning direction; and second electrodes which energize heating element groups at ends in the main scanning direction.

8. The fixing device according to claim 1, wherein the heating element pieces include three mutually adjacent heating element pieces which are aligned in the main scanning direction at an unequal interval.

9. An image forming apparatus comprising the fixing device according to claim 1.

10. A fixing device comprising:

a fixing belt configured to heat and fix a toner image formed on a sheet conveyed in a sub-scanning direction;

a surface heater configured to heat an inner peripheral surface of the fixing belt by pressibly making contact with the inner peripheral surface of the fixing belt, wherein the surface heater includes, on a surface thereof that comes in contact with the inner peripheral surface of the fixing belt:

a plurality of heating element pieces arranged in a main scanning direction perpendicular to the sub-scanning direction; and electrodes which energize the heating element pieces with electricity, of the heating element pieces, an n-th heating element piece and an (n+1)-th heating element piece are adjacent to each other, and the (n+1)-th heating element piece and a (n+2)-th heating element piece are adjacent to each other, of the paired sides, a side of the n-th heating element piece on an upstream side in the sub-scanning direction that extends in the main scanning direction and a side of the (n+1)-th heating element piece on the upstream side in the sub-scanning direction that extends in the main scanning direction are connected to each other via a corresponding one of the electrodes, a side of the n-th heating element piece on a downstream side in the sub-scanning direction that extends in the main scanning direction and a side of the (n+1)-th heating element piece on the downstream side in the sub-scanning direction that extends in the main scanning direction are not connected to each other via the electrodes, a side of the (n+1)-th heating element piece on the upstream side in the sub-scanning direction that extends in the main scanning direction and a side of the (n+2)-th heating element piece on the upstream side in the sub-scanning direction that extends in the main scanning direction are connected to each other via a corresponding one of the electrodes, and a side of the (n+1)-th heating element piece on the downstream side in the sub-scanning direction that extends in the main scanning direction and a side of the (n+2)-th heating element piece on the downstream side in the sub-scanning direction that extends in the main scanning direction are not connected to each other via the electrodes, and a ratio of a second surface area ($mm^2$) of the gap portion to a first surface area ($mm^2$) of the heating element pieces is $0<$(second surface area ($mm^2$) of the gap portion)/(first surface area ($mm^2$) of the heating element pieces)$\leq 0.5$.

11. An image forming apparatus comprising the fixing device according to claim 10.

* * * * *